United States Patent [19]

Robinson et al.

[11] Patent Number: 4,572,737

[45] Date of Patent: Feb. 25, 1986

[54] AGENTS FOR THE REMOVAL OF IMPURITIES FROM A MOLTEN METAL AND A PROCESS FOR PRODUCING SAME

[75] Inventors: Stewart W. Robinson, La Grange, Ky.; Roger W. Bartram, Basking Ridge; John A. Dehuff, Madison, both of N.J.

[73] Assignee: The BOC Group, Inc., Montvale, N.J.

[21] Appl. No.: 624,867

[22] Filed: Jun. 27, 1984

[51] Int. Cl.[4] ..... C21C 7/00

[52] U.S. Cl. ..... 75/53; 75/58; 75/257

[58] Field of Search ..... 75/53, 58, 257, 3-5

[56] References Cited

U.S. PATENT DOCUMENTS

| | | | |
|---|---|---|---|
| 3,134,667 | 5/1964 | Holowaty | 75/3 |
| 3,188,195 | 6/1965 | Price | 75/3 |
| 3,721,548 | 3/1973 | Hodge | 75/3 |
| 3,957,502 | 5/1976 | Cull | 75/58 |
| 4,033,762 | 7/1977 | Sato | 75/58 |
| 4,076,522 | 2/1978 | Yoshida | 75/58 |
| 4,260,413 | 4/1981 | Freissmuth | 75/58 |
| 4,279,643 | 7/1981 | Jackman | 75/58 |

*Primary Examiner*—Peter D. Rosenberg
*Attorney, Agent, or Firm*—Larry R. Cassett

[57] ABSTRACT

There is disclosed an agent and a method for producing the same for removing impurities from a molten metal comprising a first compound capable of reacting with and removing the impurities contained in the molten metal and a second compound coated on the first compound to form a composite. The second compound has a contact angle with the molten metal less than that of the first compound, thereby causing the composite to be more wettable in the molten metal as compared to the first compound. This allows the composite to penetrate into the molten metal, resulting in the first compound efficiently reacting with the impurity contained within the molten metal.

24 Claims, 2 Drawing Figures

AGENTS FOR THE REMOVAL OF IMPURITIES FROM A MOLTEN METAL AND A PROCESS FOR PRODUCING SAME

FIELD OF THE INVENTION

The present invention relates to an agent utilized in the removal of unwanted impurities from a molten metal and a process for producing such agent and more particularly to desulfurizing, dephosphorizing, desiliconizing, and deoxidizing agents for the desulfurization, dephosphorization, desiliconization, and deoxidation of molten iron, steel, copper, or other metals.

BACKGROUND OF THE INVENTION

Elements such as sulfur, phosphorous, silicon, and oxygen have been found to be undesirable elements which are always present in iron, copper and other metals. The presence of such elements are derived primarily from the ore, the scrap and the fluxes making up the charge, and from the fuel used. For example, there presently is a great demand in the iron and steel industry for products having relatively low sulfur content, and accordingly, the removal of this element has become of paramount importance.

In terms of other elements, the removal of phosphorous from hot metal or foundry iron is critical, since it has been found that low phosphorous content improves steel and iron castings' mechanical properties, such as toughness. The removal of silicon from blast furnace liquid metal is important, since low silicon content is required for efficient dephosphorization and also for decreasing BOF slag volume and flux consumption, thereby yielding a better BOF metallic yield and better refractory performance. The removal of oxygen from liquid metals is necessary, since a low oxygen condition is required to insure integrity of cast metals. The removal of oxygen is also required in processing liquid iron and steel not only for the purpose of increasing efficiency of desulfurization but also for improving steelmaking alloying element yield and nonmetallic inclusion control for improved mechanical and surface properties of finished steel. Finally, with respect to copper melts, the removal of oxygen is critical in improving mechanical properties such as brittleness and for better electrical conductivity.

Agents utilized to remove these impurities are normally introduced into the molten metal in the form of a composition containing the agent utilized for treating a molten metal to remove unwanted impurities in admixture with other components which are added for such purposes as increasing the flowability of the composition, promoting the distribution of the agent in the melt, and generally improving the effect of such agents to remove the unwanted impurity.

The problems associated with the underutilization of such agents for removing impurities from a molten metal result in a lack of uniformity of efficiency due at least in part to difficulties in uniformly contacting the agent with the molten metal. It has been found that there is an incomplete use of the agent in that the agent is apt to pass through the melt partially unreacted.

For example, calcium carbide has the capability of combining readily with the sulfur present in molten metals. However, the use of calcium carbide presents several difficulties, particularly since calcium carbide has a specific gravity of approximately 2.4, whereas iron has a specific gravity of 7. Therefore, the calcium carbide tends to become buoyant in the molten metal and thereby decreases the time the calcium carbide is suspended in the molten metal for the purposes of reacting with the sulfur therein. Furthermore, calcium carbide does not melt at the temperatures of molten iron and steel. Accordingly, the reaction must be effected between a solid reagent and a liquid molten metal. The reaction then depends upon the direct or intimate contact between the solid calcium carbide and the molten metal and therefore, the calcium carbide particle separation and particle penetration across the gas/metal interface into the molten metal itself.

To increase the penetration into the melt of agents used in removing impurities from a molten metal and thereby attempt to increase the dwell time and maximum surface contact between the agents and the metal, several methods have been suggested, such as increased stirring of the agent in the metal, plunging the agents—for example, magnesium impregnated coke—under the surface of the molten metal, or injecting under pressure particulate desulfurizing agents-for example, lime, calcium carbide, or calcium silicide—into the metal beneath the surface. Injected agents may be admixed with gas release compounds such as alkaline-earth carbonates, diamide lime (a precipitated carbon-containing calcium carbonate formed as a byproduct from the manufacture of dicyandiamide), which decompose to release a gas under the temperature conditions of the molten metal to achieve better mixing of the agent with the molten metal through agitation.

However, calcium carbide, for example, is poorly wetted by high carbon-containing iron. Poorly wetted desulfurizing agents in gas or mechanically stirred iron tend to resist penetration beneath the melt surface due to the high interfacial tension between the solid particles and the melt or melt/air interface. In gas injection systems where gas bubbles may be present from reagent carrier gas or from the heating of gas generating stirring agents, such as alkaline earth carbonates, the high melt surface tension repels the solid particles at the gas/-molten metal interface so that a large fraction of the injected particles are carried to the melt surface inside gas bubbles without reacting with the sulfur contained in the molten metal. The degree of wettability between solid agents used to remove impurities from a molten metal and the molten metal incorporates the concept of interfacial tension between a solid in contact with a liquid or liquid and gas interface.

There is disclosed another method for improving the efficiency of an agent to remove an impurity from a molten metal in U.S. Pat. No. 3,885,956 wherein calcium carbide particles are coated with magnesium for the purpose of protecting the calcium carbide from exposure to the atmosphere which thereby prevents the reaction of calcium carbide to form acetylene prior to its introduction into the melt. However, this coating does not increase the ability of the agent to penetrate the gas/liquid interface.

Another instance of coating an agent is shown when utilizing magnesium as a desulfurizing agent, where it has been found with respect to desulfurization with magnesium that magnesium or magnesium-based desulfurizing agents tend to "flash" or vaporize when added to the molten metal due to the fact that the magnesium metal has a boiling point less than that of a molten metal, such as iron or steel. Accordingly, the vaporization of the magnesium causes the magnesium to rise through the molten metal without fully reacting with the sulfur. This thereby decreases dwell time and limits the efficiency of the magnesium as a desulfurizing agent. To overcome this problem, there is disclosed in Japanese Abstract No. 136,199 a method of coating magnesium with zirconium oxide and titanium oxide to insulate the magnesium, thereby reducing its vaporization rate in the molten bath and causing it to have a longer dwell time in the bath to react with the sulfur contained therein.

Despite these various suggested improvements, the effectiveness and efficiency of a desulfurizing agent or its method of application still leaves a great deal to be desired. Accordingly, the industry has utilized a greater amount of agent to remove impurities from a molten metal at great expense to achieve the desired results.

SUMMARY OF THE INVENTION

In accordance with the present invention, it has been discovered that these disadvantages can be overcome by utilizing an agent for removing impurities from a molten metal comprising a first compound capable of reacting with and removing the impurities contained in the molten metal and a second compound coated on the first compound to form a composite, the second compound having a contact angle with the molten metal less than that of the first compound, thereby causing the composite to be more wettable in the molten metal as compared to the first compound, allowing the composite to penetrate into the molten metal, resulting in the first compound reacting with the impurity contained within the molten metal.

There is further disclosed another embodiment of the present invention wherein an agent for removing impurities from a molten metal comprising a first compound capable of reacting with and removing the impurities contained in the molten metal, and an intermediary compound coated on the first compound, the intermediary compound capable of depositing on the first compound a second compound under the conditions of the molten metal to form a composite, the second compound having a contact angle with the molten metal less than that of the first compound, thereby causing the composite to be more wettable as compared to the first compound in the molten metal, allowing the composite to penetrate into the molten metal, resulting in the first compound reacting with the impurities within the molten metal.

In accordance with another embodiment of the present invention, there is disclosed a method for preparing an agent utilized for the removal of an impurity from a molten metal comprising applying to a first compound a binding agent and coating the first compound and binding agent with a second compound to form a composite, said second compound having a contact angle with the molten metal less than that of said first compound, thereby causing the composite to be more wettable as compared to the first compound with the molten metal.

There is further disclosed herein a process for removing impurities from a molten metal comprising introducing into the molten metal a composite formed from a first compound capable of reacting with and removing the impurity contained in the molten metal bath, the first compound being coated with a second compound having a contact angle with the molten metal less than that of the first compound, thereby causing the composite to be more wettable as compared to the first compound for the purpose of penetration into said molten metal.

BRIEF DESCRIPTION OF THE DRAWINGS

Other objects and advantages of the present invention will become apparent by reference to the following detailed description of an embodiment thereof when taken in conjunction with the accompanying drawings in which.

DETAILED DESCRIPTION OF THE INVENTION

Figure 1:
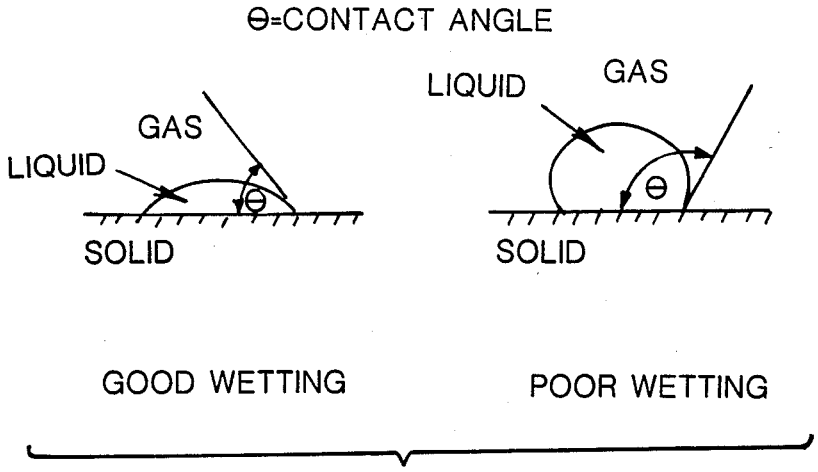
FIG. 1 illustrates the concept of wettability of a solid reagent in a liquid.

As previously stated, elements such as sulfur, phosphorous, silicon, and oxygen are usually considered to be undesirable elements which are always present in iron and other metals. The presence of such elements is derived primarily from the ore, the scrap and the fluxes making up the charge, and from the fuel used. Because of the technological requirements for metal products having low sulfur, phosphorous, silicon, and oxygen content, there is a necessity for a practical and economical method for reducing the content of such elements contained in the metal.

In an attempt to decrease the amount of these elements contained in iron, steel, copper, and other metals, the industry has made extensive use of numerous agents. For example, with respect to desulfurization of a molten iron or steel, the following desulfurizing agents have been used: calcium carbide, lime (calcium oxide), calcium silicide, basic slags, magnesium, and mixtures thereof. An agent utilized for the removal of silicon from a molten ferrous metal is mill scale or ore (iron oxides). The removal of phosphorous from a molten metal can be achieved through the utilization of soda ash and lime-based flux. Finally, for the removal of oxygen in a molten iron, aluminum is utilized; in molten steel, silicon, manganese, or aluminum have been found to be the agents of choice; and in a molten copper melt, phosphorous or a calcium-boron alloy can be used.

During the processing of the molten metal, such as iron, steel, or copper, the treatment by an agent to remove the impurities contained therein can take place while the molten metal is contained in a transfer or holding ladle, a mixer vessel which contains the molten metal from the blast furnace, such as iron, prior to its conversion to steel, or in a torpedo ladle. As also known in the art, the treatment of the molten metal to remove the impurities can also be accomplished by adding the agent to the molten metal as such molten metal flows from one vessel to another or as utilized in a foundry by stirring the agent into the molten metal or finally, as primarily used in a steel mill, by pressure injecting into the molten metal the agent contained in a transport medium.

In the case of desulfurizing agents such as calcium carbide or lime, which have melting points higher than that of molten iron, an initial problem arises in that the mechanism of desulfurization is dependent upon a solid and liquid interface, that is, the interface between the reactive calcium carbide or lime and the molten metal containing the sulfur. There is never a question of vaporization and boiling off as previously described for magnesium. Therefore, the efficiency of the desulfurization treatment with calcium carbide or lime will depend upon the number of particles of the desulfurizing agent that will separate and penetrate the gas/liquid interface. This penetration of the gas/liquid interface by the solid particle agent is determined by the contact angle of the agent, such as calcium carbide or lime, between the gas and molten metal.

A second problem that arises from the use of calcium carbide and lime is that these compounds have specific gravities less than that of iron and steel, and accordingly, it has been found that the efficiency of the desulfurizing agent not only depends on the penetration of the agent into the molten metal but, further, also upon the dwell time of the reagent within the molten bath. (Specific gravity of calcium carbide=2.4; specific gravity of lime=3.3; specific gravity of iron=7; and the specific gravity of steel=approximately 7.2) There is a tendency for these desulfurizing agents to show the characteristic of buoyancy—that is, the reagent, when placed in the molten metal, is apt to pass through the metal unreacted or partially reacted and sit on the surface of the molten metal in the slag. This thereby also decreases the efficiency of the desulfurizing agent.

Accordingly, in an attempt to increase the interfacial contact between the molten metal containing the impurity and an agent to be utilized to remove the impurity and further to increase the dwell time of the agent within the molten metal, processes have been developed requiring extensive stirring of the agent in the molten metal or alternatively, agitating the molten bath by admixing the agent used to remove the impurity with gas-releasing compounds in an attempt to limit the amount of desulfurizing agent that rises to the surface unreacted or only partially reacted.

Although agitation methods for suspension of entrained particles have increased the efficiency of the agent used to remove the impurities somewhat, in practice the simple agitation or stirring of the agent in the molten metal still does not increase reagent efficiencies to an optimum level.

Therefore, it has been found that in order to achieve the desired chemical effect of removing the impurity from the molten metal whether or not the desulfurizing agent, such as calcium carbide or lime with respect to the desulfurization of iron or other agents with respect to the dephosphorization, desiliconization, or deoxidation of iron, steel, or copper, is injected or stirred in, improved contact between the solid surface and the molten metal must occur and that contact must persist for a reasonable period of time. To develop this contact and thereby increase the penetration of the agent, kinetic energy must be supplied to the solid reagent particles by methods such as melt stirring or gas/particle pneumatic injection to overcome the resistance effects of: (1) buoyancy from the large specific gravity difference between the molten metal and reagent, (2) momentum loss due to liquid resistance to particle or gas/particle jet penetration, and (3) the resistance due to interfacial tension at solid/liquid and solid/gas/liquid interfaces.

The present invention addresses the latter resistance effect—namely, reduction of interfacial tension—also referred to as the work of wetting, which must be overcome to achieve penetration of particles through solid/gas/liquid interfaces and to effect liquid spreading over the solid surface to achieve particle contact with the melt. In stirred melt treatment processes, which are common in foundry practice, solid/gas/liquid metal interfaces occur at the melt surface where the gas phase is the atmosphere above the melt surface. In injection processes, common in steel works, such interfaces may occur as gas-enveloped particles beneath the melt surface.

Agents which are poorly wetted by the molten metal will tend to resist penetration into the melt and spreading of liquid metal over particle surfaces will be limited due to high interfacial tension between the particles and the melt. Metal treating process efficiency will therefore be limited. In stirred systems, melt surface penetration by poorly wetted particles will be incomplete, and in injection processes, a large fraction of injected particles will be swept to the melt top surface unreacted.

The concept of interfacial tension and therefore degree of wettability is shown in FIG. 1. Low interfacial tension systems encourage good wetting and therefore spontaneous spreading of liquid over the surface of the solid with concomitant high liquid/solid contact which helps to promote chemical reaction—for instance, transfer of sulfur from iron to solid desulfurizers. Interfacial tension may be measured by the contact angle $\theta$ between a liquid drop resting on the surface of a solid under a controlled gas atmosphere as shown in FIG. 1. The lower the contact angle, the greater the degree of wettability of the particle and therefore the less energy required for penetration of the particle into liquid.

It has been found that the degree of wettability between molten metal and solid reagent affects, to a large extent, the efficiency of utilization of solid reagent in the molten metal treating operations such as desulfurization. To overcome the difficulties in obtaining effective reagent utilization, the industry has been required to use greater amounts of desulfurizing agents at great expense to achieve desired results. Use of additional reagent material results in longer melt treatment times and excessive slag volumes with attendant processing costs.

Desulfurizing agents which have high contact angles with molten metals, such as calcium carbide with foundry or blast furnace iron or lime with steel, therefore have less tendency for the desulfurizing agent particles to penetrate the gas/liquid metal interface as opposed to desulfurizing agents which have low contact angles with molten metals. Therefore, the amount of desulfurizing agent actually exposed to the molten metal and therefore reactable with the sulfur contained therein will not equal or even come close to the total amount of agent added to the melt. It has been determined that if a particle can be made more wettable and therefore require less energy to cross the gas/liquid interface, this would inevitably expose more of the agent to the molten metal and thereby increase the efficiency of the desulfurizing agent, since a greater amount of agent will be exposed to the sulfur contained therein.

By the process of the present invention, it has been found that the wettability of reagents, such as calcium carbide or lime-based reagents, can be increased and thereby increase the ease of particle separation and penetration into the molten metal, which as a result increases reagent efficiency. This increase in wettability of the particle is achieved by coating the desulfurizing agent with a material having a contact angle with the molten metal that is less than the contact angle of the agent to be used. This will, upon introduction into the molten metal either by stirring or injection, cause a greater number of particles of the agent to penetrate and thereby pass through the gas/liquid interface, thereby improving the efficiency of the reagent.

In preparing the agent of the present invention—for example, calcium carbide for use in a foundry process to produce nodular iron—the calcium carbide is usually of a particle size of from 8 to 100 mesh. The calcium carbide or solid coating material having a contact angle with the molten metal that is less than that for the calcium carbide may be treated with a binding agent such as a petroleum oil, mineral oil, or silicone-containing fluid. The metal treating agent, such as calcium carbide, is then coated with the coating material with or without a binding agent. Such materials or agents that can be used to coat calcium carbide or other iron or steel desulfurizing agents such as lime are titanium dioxide ($TiO_2$), ferric oxide ($Fe_2O_3$), calcium aluminate ($3CaO.Al_2O_3$), calcium hydroxide ($Ca(OH)_2$), fluorspar, iron powder, fumed titania, fumed silica, and other materials having low contact angles and which are therefore highly wettable with the molten metal bath. In addition to solid coating materials, liquid coatings which leave deposits of metal wettable coatings under the temperature conditions of the melt may also be used. Examples of liquid coating materials are organometallic fluids such as silicone-containing fluid or titanium dioxide-containing fluids which deposit coatings on solid treating agents for molten metal having a contact angle with the molten metal less than that for the metal treating agent.

When utilizing a calcium carbide or lime reagent that will be injected beneath the surface of the molten metal, such as processing that takes place in steel mills, the calcium carbide or lime is of a particle size less than 100 mesh. The coating material utilized to increase the wettability of the desulfurizing agent and thereby overcome the effects of the contact angle of the calcium carbide or lime with the molten metal and increase ease of particle penetration into the metal can be, for example, a titanium dioxide-containing fluid, silicone-containing fluid, fumed titanium oxide, fumed silicon dioxide, and any other liquid or ultrafine particulate matter having a high wettability with the liquid metal.

The apparent mechanism which increases the efficiency of the coated calcium carbide or lime is based on the fact that since the particle coated reagents are more wettable than the uncoated calcium carbide or lime, such particles can more easily penetrate and thereby cross the gas/liquid interface, since less energy is needed to overcome the work of wetting of the particle. This results in a greater number of particles being entrained within the melt. Upon entering the melt, the coating is disrupted by the liquid ferrous metal by either reacting with the coating or surface layer or decomposing the coating because of the temperature of the metal. Additionally, the coating can be disrupted by fluxing whereby the coating forms a liquid compound with the substrate which is then degraded or which reacts with the melt, thereby exposing the calcium carbide or lime to react with the sulfur contained within the melt.

It has been found that through the utilization of the desulfurizing agent of the present invention, there is a saving in the amount of desulfurizing agent used, since the same quantity of desulfurizing agent will remove a greater amount of the sulfur contained therein within a limited period of time. Accordingly, it has further been found that based on this fact, the amount of desulfurizing agent of the present invention used can be significantly reduced to achieve the same results as a greater amount of uncoated desulfurizing agent. An additional benefit is the reduction in the volume of the slag layer on the metal which reduces the costs of processing. The following specific examples will serve to illustrate the embodiments of this invention.

EXAMPLE NO. 1

Using a laboratory melting unit, desulfurizing agent efficiency was evaluated by measuring and comparing the desulfurization performance of uncoated calcium carbide, calcium carbide coated with an agent having a contact angle with molten iron less than calcium carbide, and calcium carbide coated with an agent having a contact angle greater than calcium carbide. Prior to adding the classes of desulfurizing agent described above, the sulfur content of the pig iron was initially measured. The coated and uncoated calcium carbide had a particle size of 14×20 mesh. The coated calcium carbides were prepared by applying a heavy-weight oil on said particles and then coating these particles with a number of different coating agents.

Following the coating a quantity of each of the prepared desulfurizing agents equivalent to 14.3 pounds of reagent/ton of iron was stirred at a rate of 400 rpm into pig iron at a temperature of 2750° F. to best simulate a commercial procedure. The laboratory unit was operated with 1380 grams of metal and 9.7 grams of reagent.

Following the introduction of the desulfurizing agent, the percent of sulfur was measured after one minute and subsequently after seven minutes. Based upon these measurements, the percent of stoichiometric efficiency of the desulfurizing agent was determined.

The results of the laboratory test data are set forth in Table 1. The coating materials appearing above the indication of "none (uncoated)" on the chart have contact angles with molten iron greater than calcium carbide whereas those below have contact angles less than calcium carbide.

TABLE I

| | | Coated 14 × 20 Mesh Calcium Carbide Laboratory Iron Desulfurization | | | | | |
|---|---|---|---|---|---|---|---|
| Coating Material | Initial Melt % Sulfur | % Sulfur @ 1 Min | ΔS (points) 1st Min | % Stoich Effic. @ 1 Min | % Sulfur @ 7 Min | ΔS (Points) 7th Min | % Stoich Effic. @ 7 Min |
| Alumina | .106 | .095 | 11 | 3.9 | .073 | 33 | 11.6 |
| Graphite | .113 | .099 | 14 | 5.0 | .060 | 53 | 18.9 |
| None (Uncoated) | .109 | .091 | 18 | 6.3 | .052 | 57 | 19.8 |
| Portland Cement | .098 | .078 | 20 | 7.2 | .042 | 56 | 20.1 |
| Lime | .114 | .090 | 24 | 8.9 | .053 | 61 | 22.5 |
| Calcium Aluminate Cement | .101 | .074 | 27 | 9.5 | .036 | 65 | 22.8 |
| Fluorspar | .105 | .077 | 28 | 9.6 | .035 | 70 | 24.0 |
| Iron Powder | .115 | .084 | 31 | 10.5 | .047 | 68 | 22.9 |

TABLE I-continued

| Coating Material | Initial Melt % Sulfur | Coated 14 × 20 Mesh Calcium Carbide Laboratory Iron Desulfurization % Sulfur @ 1 Min | ΔS (points) 1st Min | % Stoich Effic. @ 1 Min | % Sulfur @ 7 Min | ΔS (Points) 7th Min | % Stoich Effic. @ 7 Min |
|---|---|---|---|---|---|---|---|
| Silicone Fluid | .109 | .076 | 33 | 11.1 | .022 | 87 | 29.0 |
| Calcium Hydroxide | .112 | .076 | 36 | 12.2 | .045 | 67 | 22.5 |
| Ferric Oxide | .107 | .069 | 38 | 13.1 | .043 | 64 | 19.5 |
| Tricalcium Aluminate | .117 | .079 | 38 | 13.6 | .031 | 86 | 30.6 |
| Titanate Coupling Liquid | .108 | .067 | 41 | 14.0 | .024 | 84 | 28.6 |
| Fumed Titanium Oxide | .108 | .066 | 42 | 14.4 | .032 | 76 | 25.9 |
| Titanium Dioxide Powder | .104 | .062 | 42 | 15.1 | .027 | 77 | 27.5 |

As is quite apparent from the table, those compounds coated on the calcium carbide with contact angles less than calcium carbide showed a marked increase in stoichiometric efficiency for the removal of sulfur after one minute as compared to uncoated calcium carbide and calcium carbide coated with substances having contact angles greater than calcium carbide. This same trend continued after seven minutes.

EXAMPLE NO. 2

Under the same conditions as described in Example 1, calcium carbide uncoated and coated with materials having higher and lower interfacial energies, as indicated by contact angle, were once more run.

Figure 2:
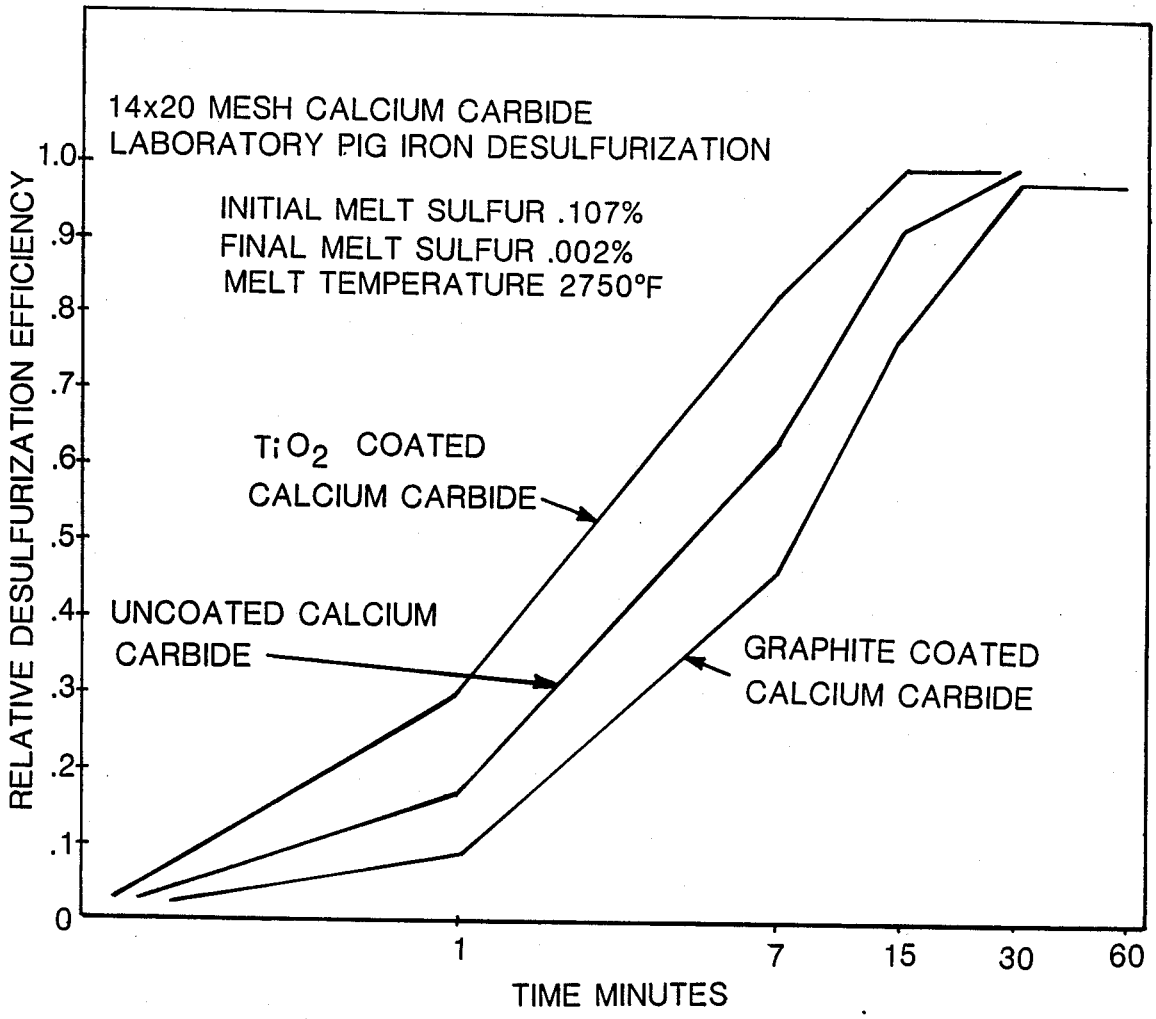
FIG. 2 is a graphical representation showing the efficiency of the present invention.

As shown in FIG. 2, the reagent with a wettable surface such as titanium dioxide coated carbide improves the rate of desulfurization during the first minutes of desulfurization treatment and improves reagent utilization efficiency during the commercially available melt treatment period of 7–15 minutes as compared to uncoated reagent. At longer periods of time of 90–180 minutes, laboratory desulfurization results converge at 0.002 percent sulfur contained in the molten iron. To further illustrate the importance of wettability in metal treating operations, FIG. 2 also shows reduction in reagent utilization efficiencies when a reagent coated with graphite which has a contact angle with molten pig iron greater than that of calcium carbide is used.

This therefore illustrates the importance of solid reagent wettability upon initial melt contact to effect efficient reagent utilization during treatment times of 7–15 minutes common in the industry. This further points out the increased penetration of the desulfurizing agent that is coated with a more wettable compound, since more agent will penetrate the gas/liquid interface to be entrained within the molten melt to scavange for the sulfur.

EXAMPLE NO. 3

Again using the laboratory melting unit as described in Example No. 1, an injection carbide of less than 150 mesh was coated with a number of agents having contact angles less than that for the calcium carbide. Although of injection grade, the coated desulfurizing agents and uncoated desulfurizing agent were stirred into the laboratory melts. The temperature of the melts was approximately 2500° F. The results of the laborabory tests are set forth in Table 2. From these results it is very obvious that the stoichiometric efficiency for the removal of sulfur from the melt showed a marked improvement for the coated material rather than the uncoated material.

TABLE II

| Coating Material | Initial Melt % Sulfur | Coated 150 Mesh Calcium Carbide Laboratory Iron Desulfurization % Sulfur @ 1 Min | ΔS (points) 1st Min | % Stoich Effic. @ 1 Min | % Sulfur @ 7 Min | ΔS (Points) 7th Min | % Stoich Effic. @ 7 Min |
|---|---|---|---|---|---|---|---|
| None (Uncoated) | .072 | .061 | 11 | 6.6 | .039 | 33 | 19.6 |
| Fumed Titanium Oxide | .076 | .056 | 20 | 12.3 | .026 | 50 | 30.4 |
| Silicon Fluid | .075 | .038 | 37 | 22.4 | .017 | 58 | 34.8 |
| Titanate Fluid | .068 | .021 | 47 | 28.3 | .010 | 58 | 34.8 |

EXAMPLE NO. 4

Cupola-produced iron at a commercial foundry was desulfurized with −16+80 mesh calcium carbide using a continuous porous plug process. Average iron temperature was 2810° F., and predesulfurization iron chemical analysis was: 3.7 percent carbon, 0.4 percent Mn, 2.0 percent Si, 0.120 percent sulfur.

Molten iron at 30 tons/hour continuously flowed into a 5-ton bottom porous plug treatment ladle and 22 pounds/ton calcium carbide were concurrently applied to the surface of the nitrogen agitated ladle to reduce the sulfur content of the molten iron to 0.008 percent. The stoichiometric desulfurization chemical efficiency of the process based on the calcium carbide contained in the calcium carbide was 26.1 percent. Silicone fluid-coated calcium carbide was substituted for uncoated calcium carbide in the above-described porous plug desulfurization process to achieve reduction of sulfur content of iron from 0.120 percent to 0.008 percent, wherein 10.6 pounds per ton calcium carbide was required. The reagent consumption represented a stoichiometric desulfurization efficiency of 54.2 percent. Use of coated calcium carbide therefore permitted a 52 percent reduction in reagent required.

Naturally, the invention is not limited solely to the embodiment described above but may be modified within the scope of the following claims.

What is claimed:

1. An agent for removing impurities from a preselected molten metal comprising a first compound capable of reacting with and removing said impurities contained in said preselected molten metal, said first compound comprising calcium carbide, and a second compound coated on said first compound to form a composite, said second compound having a contact angle with said preselected molten metal less than that of said first compound, thereby causing said composite to be more wettable as compared to said first compound in said preselected molten metal, allowing said composite to penetrate into said preselected molten metal resulting in said first compound reacting with said impurities contained within said preselected molten metal.

2. The agent for removing impurities from said preselected molten metal as defined in claim 1 wherein said preselected molten metal is iron or steel.

3. The agent for removing impurities from a molten metal as defined in claim 2 wherein said first compound is substantially pure calcium carbide.

4. The agent for removing impurities from a molten metal as defined in claim 2 wherein said second compound is selected from the group consisting of a titanium oxide-based material, ferric oxide, calcium aluminate based material, calcium hydroxide, fluorspar, iron powder, fumed silica, and mixtures thereof.

5. An agent for removing impurities from a molten metal as defined in claim 1 further comprising a binding agent applied to said first compound or said second compound prior to said coating with said second compound.

6. An agent for removing impurities from a molten metal as defined in claim 5 wherein said binding agent is selected from the group consisting of petroleum oil, silicone fluid, titanate fluid, mineral oil, and mixtures thereof.

7. An agent for removing impurities from a preselected molten metal comprising a first compound capable of reacting with and removing said impurities contained in said preselected molten metal, said first compound comprising calcium carbide, and an intermediary compound coated on said first compound, said intermediary compound capable of depositing on said first compound a second compound under the conditions of a preselected molten metal to form a composite, said second compound having a contact angle with said preselected molten metal less than that of said first compound, thereby causing said composite to be more wettable as compared to said first compound in said preselected molten metal, allowing said composite to penetrate into said preselected molten metal resulting in said first compound reacting with said impurities within said preselected molten metal.

8. The agent for removing impurities from said preselected molten metal as defined in claim 7 wherein said preselected molten metal is iron or steel.

9. The agent for removing impurities from a molten metal as defined in claim 8 wherein said first compound is substantially pure calcium carbide.

10. The agent for removing impurities from a molten metal as defined in claim 8 wherein said intermediary compound is selected from the group consisting of a silicone fluid, a titanate fluid, and mixtures thereof.

11. A method for preparing an agent utilized for the removal of an impurity from a preselected molten metal comprising the steps of applying to a first or second compound a binding agent, said first compound capable of reacting with and removing said impurities, said first compound comprising calcium carbide; and coating said first compound with said second compound having a contact angle with said preselected molten metal less than that of said first compound, thereby causing the composite to be more wettable as compared with the first compound with said preselected molten metal.

12. The method for preparing an agent utilized for the removal of an impurity from a molten metal as defined in claim 11 wherein said first compound is substantially pure calcium carbide.

13. The method for preparing an agent utilized for the removal of an impurity from a molten metal as defined in claim 11 wherein said second compound is selected from the group consisting of a titanium oxide-based material, ferric oxide, calcium aluminate based material, calcium hydroxide, fluorspar, iron powder, fumed silica, and mixtures thereof.

14. The method for preparing an agent utilized for the removal of an impurity from a molten metal as defined in claim 11 wherein said binding agent is selected from the group consisting of a petroleum oil, a silicon fluid, a mineral oil, a titanate fluid, and mixtures thereof.

15. A process for removing impurities from a molten metal comprising introducing into the molten metal a composite formed from a first compound capable of reacting with and removing the impurities contained in the molten metal, said first compound comprising calcium carbide, the first compound being coated with a second compound having a contact angle with the molten metal less than that of the first compound, thereby causing the composite to be more wettable as compared to the first compound for the purpose of penetration into said molten metal.

16. The process as defined in claim 15 wherein said molten metal is iron or steel.

17. The process as defined in claim 16 wherein said first compound is substantially pure calcium carbide.

18. The process as defined in claim 16 wherein said second compound is selected from the group consisting of a titanium oxide-based material, ferric oxide, calcium aluminate based material, calcium hydroxide, fluorspar, iron powder, fumed silica, and mixtures thereof.

19. A process as defined in claim 15 further comprising a binding agent applied to said first compound or second compound prior to coating said first compound with said second compound.

20. A process as defined in claim 19 wherein said binding agent is selected from the group consisting of petroleum oil, a silicone fluid, a titanate fluid, a mineral oil, and mixtures thereof.

21. A process for removing impurities from a molten metal comprising introducing into the molten metal a composite formed from a first compound capable of reacting with and removing the impurities contained in the molten metal, said first compound comprising calcium carbide, the first compound being coated with an intermediary compound, said intermediary compound capable of depositing on said first compound under the conditions of the melt a second compound to form a composite, said second compound having a contact angle with the molten metal less than that of the first compound, thereby causing the composite to be more wettable as compared to the first compound for the purpose of penetration into said molten metal.

22. The process as defined in claim 21 wherein said molten metal is iron or steel.

23. The process as defined in claim 22 wherein said first compound is substantially pure calcium carbide.

24. The process as defined in claim 22 wherein said intermediary compound is selected from the group consisting of silicone fluid, titanate fluid, and mixtures thereof.

* * * * *